US007859379B2

(12) United States Patent
Uemura

(10) Patent No.: US 7,859,379 B2
(45) Date of Patent: Dec. 28, 2010

(54) TRANSFORMER CORE AND ITS MANUFACTURING METHOD

(75) Inventor: Masayasu Uemura, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 413 days.

(21) Appl. No.: 12/090,597

(22) PCT Filed: May 16, 2007

(86) PCT No.: PCT/JP2007/060011

§ 371 (c)(1),
(2), (4) Date: Apr. 17, 2008

(87) PCT Pub. No.: WO2007/132878

PCT Pub. Date: Nov. 22, 2007

(65) Prior Publication Data

US 2009/0277571 A1 Nov. 12, 2009

(30) Foreign Application Priority Data

May 16, 2006 (JP) ..... 2006-135942

(51) Int. Cl.

| | |
|---|---|
| ***H01F 27/02*** | (2006.01) |
| ***H01F 38/20*** | (2006.01) |
| ***H01F 17/06*** | (2006.01) |
| ***H01F 27/30*** | (2006.01) |
| ***H01F 27/26*** | (2006.01) |
| ***H01F 27/24*** | (2006.01) |
| *H01F 27/28* | (2006.01) |

(52) U.S. Cl. ..... 336/92; 336/83; 336/90; 336/94; 336/96; 336/174; 336/175; 336/176; 336/178; 336/206; 336/210; 336/216; 336/229; 336/233

(58) Field of Classification Search ..... 336/83, 336/90–96, 174–176, 178, 206, 210, 212, 336/216, 229, 233
See application file for complete search history.

(56) References Cited

U.S. PATENT DOCUMENTS 4,873,505 A * 10/1989 Matsui ..... 336/92

(Continued)

FOREIGN PATENT DOCUMENTS

JP 61-157313 U 9/1986

(Continued)

OTHER PUBLICATIONS

Tadasi Mitsui; "Ferrite Core For Power Supply," TDK Corporation; Magnetic Material Headquarter; Ferrite Department; Apr. 1996; vol. 19; pp. 1-4.

(Continued)

*Primary Examiner*—Elvin G Enad
*Assistant Examiner*—Ronald W Hinson
(74) *Attorney, Agent, or Firm*—Westerman, Hattori, Daniels & Adrian, LLP

(57) ABSTRACT

It is possible to provide a transformer core which can be mounted on a coil having both ends connected to a substrate or the like and can simplify the step for arranging an adhesive layer and suppress fluctuation of a magnetic gap. The transformer core (1) includes: a rectangular spacer (5, 20) having a region where a first convex portion (10, 21) is formed on the four sides of one of the surfaces as a unitary block and the first convex portion is not provided at least at a part of a pair of two opposing sides; and a sheet-shaped adhesive layer (6) bonded to a region where at least the first convex portion is not provided on the one of the surfaces of the spacer and connecting a soft ferrite core (4) to the spacer.

10 Claims, 7 Drawing Sheets

U.S. PATENT DOCUMENTS

| | | | | |
|---|---|---|---|---|
| 5,942,964 | A * | 8/1999 | Takeuchi | 336/92 |
| 6,078,241 | A * | 6/2000 | Watanabe et al. | 336/92 |
| 6,469,589 | B2 * | 10/2002 | Takeda | 333/12 |
| 7,443,275 | B2 * | 10/2008 | Konz | 336/178 |

FOREIGN PATENT DOCUMENTS

| | | | |
|---|---|---|---|
| JP | 7-263250 | A | 10/1995 |
| JP | 8-17649 | A | 1/1996 |
| JP | 10-135059 | A | 5/1998 |
| JP | 2002-158113 | A | 5/2002 |
| JP | 2002-299128 | A | 10/2002 |

OTHER PUBLICATIONS

International Search Report of PCT/JP2007/60011, date of mailing Aug. 21, 2007.

* cited by examiner

TRANSFORMER CORE AND ITS MANUFACTURING METHOD

TECHNICAL FIELD

The present invention relates to a transformer core and its manufacturing method, and more particularly, it relates to a transformer core whose ferrite core has a magnetic gap and its manufacturing method.

BACKGROUND ART

In relation to a transformer core used under such a condition that a direct current is superimposed on a coil, a technique of providing a magnetic gap serving as a space (clearance) on a part of a magnetic path in order to prevent magnetic saturation of the core is widely known in general. In this case, a soft ferrite core of Mn—Zn, Ni—Zn and so on is used as a magnetic core.

In a case of forming a magnetic gap in an annular magnetic core, there is such an inconvenience that the inductance of a transformer core may remarkably vary due to change of the magnetic gap during the use of the magnetic core. The magnetic gap fluctuates due to the working environment (temperature change, humidity change, pressure change, vibration, weather resistance and impact) of the transformer core after mounting. Therefore, Japanese Patent Laying-Open No. 8-17649 proposes a structure fixing a spacer in a state inserted into a magnetic gap thereby suppressing fluctuation of the magnetic gap.

In the structure proposed in Japanese Patent Laying-Open No. 8-17649, there is disclosed a core case assembly comprising a core case storing one annular core having one magnetic gap therein while having one case-side gap corresponding to the magnetic gap and one spacer having a spacer body portion slid from a direction parallel to a surface of the annular core constituting the magnetic gap to be press-fitted into the magnetic gap and a platelike cover portion integrally formed on three sides of the spacer body portion. In this core assembly according to Japanese Patent Laying-Open No. 8-17649, a pasty adhesive made of adhesive resin or the like is applied to or injected into the space between the spacer body portion and the platelike cover portion and the magnetic gap and the peripheral portion thereof and solidified (cured), thereby preventing the spacer from dropping by vibration or the like. In this core case assembly, the spacer body portion can the magnetic gap of the annular core constant.

In the core case assembly disclosed in the aforementioned Japanese Patent Laying-Open No. 8-17649, however, the core case and the annular core are so annularly formed as to have one magnetic gap, whereby it is difficult to remarkably expand the magnetic gap. Therefore, there is such a problem that it is difficult to mount the core case assembly disclosed in the aforementioned Japanese Patent Laying-Open No. 8-17649 on a coil whose both ends are connected to a substrate or the like. Further, the core case assembly disclosed in the aforementioned Japanese Patent Laying-Open No. 8-17649 has such an inconvenience that the operation of applying or injecting the pasty adhesive to or into the space between the spacer body portion and the platelike cover portion and the magnetic gap and the peripheral portion thereof and solidifying (curing) the same is complicated and requires time. Therefore, there is such a problem that it is difficult to simplify a step of providing an adhesive layer.

DISCLOSURE OF THE INVENTION

The present invention has been proposed in order to solve the aforementioned problems, and an object of the present invention is to provide a transformer core mountable also on a coil whose both ends are connected to a substrate or the like, capable of simplifying a step of providing adhesive layers and capable of inhibiting a magnetic gap from fluctuation and a its manufacturing method.

A transformer core according to a first aspect of the present invention comprises a pair of soft ferrite cores having semicircular inner peripheral surfaces, a pair of core cases storing the pair of soft ferrite cores therein respectively so that the pair of soft ferrite cores are opposed to each other to constitute a magnetic gap, a clamp mechanism coupling first ends of the pair of core cases with each other in an openable/closable manner, a rectangular spacer arranged in the magnetic gap and integrally provided with first convex portions on four sides of a first surface while having regions not provided with the first convex portions on at least parts of a pair of opposing sides and sheet-shaped adhesive layers bonded to at least the regions of the first surface of the spacer not provided with the first convex portions, for bonding the soft ferrite cores and the spacer to each other.

In this transformer core according to the first aspect, as hereinabove described, the pair of semicircular soft ferrite cores are stored in the pair of core cases so that the pair of soft ferrite cores are opposed to each other to form the magnetic gap while the first ends of the pair of core cases are coupled with each other by the openable/closable clamp mechanism so that the pair of core cases can be mounted on a coil in an open state, whereby the pair of semicircular soft ferrite cores can be easily mounted also on a coil whose both ends are connected to a substrate or the like. Further, the rectangular spacer is arranged in the magnetic gap of the soft ferrite cores while the first convex portions are integrally provided on the four sides of the first surface of the spacer so that the spacer can be inhibited from slipping off the magnetic gap of the soft ferrite cores, whereby the magnetic gap can be inhibited from fluctuation. In addition, the regions not provided with the first convex portions are formed on at least a pair of opposing sides of the spacer while the sheet-shaped adhesive layers for bonding the soft ferrite cores and the spacer to each other are bonded to at least the regions not provided with the first convex portions, whereby the step of providing the adhesive layers can be simplified as compared with a case of applying or injecting a pasty adhesive and solidifying (curing) the same. Further, a sheet-shaped adhesive is bonded to the regions of at least a pair of opposing sides of the spacer not provided with the first convex portions so that a step of bonding the adhesive layers by so arranging a plurality of spacers as to couple the regions not provided with the first convex portions with each other while bonding the sheet-shaped adhesive layers to extend over the regions of the plurality of spacers not provided with the first convex portions can be carried out, whereby the sheet-shaped adhesive layers can be simultaneously provided with respect to the plurality of spacers. Thus, the step of providing the adhesive layers can be further simplified. In addition, one of the soft ferrite cores and the spacer can be easily bonded to each other with the sheet-shaped adhesive layers, whereby the spacer can be inhibited from slipping off the magnetic gap of the soft ferrite cores even when the pair of core cases are rendered openable/closable with the clamp mechanism.

In the aforementioned transformer core according to the first aspect, the sheet-shaped adhesive layers preferably have a width not more than the width of the regions not provided with the first convex portions. According to this structure, the sheet-shaped adhesive can be easily bonded to the regions not provided with the first convex portions, whereby the step of providing the adhesive layers can be easily simplified.

In the aforementioned transformer core according to the first aspect, the sheet-shaped adhesive layers preferably have a substantially unchanging thickness. According to this structure, the surfaces of the soft ferrite cores constituting the magnetic gap and the spacer can be parallelly bonded to each other dissimilarly to a case where the thickness of the sheet-shaped adhesive layers changes, whereby the magnetic gap of the pair of opposite soft ferrite cores can be kept constant.

In the aforementioned transformer core according to the first aspect, the spacer is preferably so formed as to be mounted on first surfaces of the soft ferrite cores constituting the magnetic gap from a vertical direction through the sheet-shaped adhesive layers. When the transformer core is so formed as to mount the spacer from the vertical direction in this manner, the spacer can be easily mounted on the first surfaces of the soft ferrite cores even when the first convex portions are provided on the four sides of the spacer.

In the aforementioned transformer core according to the first aspect, the spacer is preferably provided with the regions not provided with the first convex portions on parts of the pair of opposing sides out of the four sides of the first surface in order to bond the sheet-shaped adhesive layers, while the first convex portions are preferably provided substantially on all regions of the remaining pair of opposing sides. According to this structure, contact areas between the peripheral portions of the surfaces of the soft ferrite cores constituting the magnetic gap and the first convex portions of the spacer can be increased when the spacer is bonded to the surfaces of the soft ferrite cores constituting the magnetic gap, whereby the spacer can be more effectively inhibited from slipping off the magnetic gap of the soft ferrite cores.

In the aforementioned transformer core according to the first aspect, the spacer is preferably provided with the regions not provided with the first convex portions on the pair of opposing sides and the remaining pair of opposing sides out of the four sides of the first surface respectively for bonding the sheet-shaped adhesive layers. According to this structure, the adhesive layers can be arranged on both of the vertical and horizontal directions of the first surface of the spacer, whereby workability at the time of bonding the adhesive layers to the spacer can be improved.

In the aforementioned transformer core according to the first aspect, the spacer is preferably integrally provided with second convex portions on substantially all regions of the four sides of a second surface. According to this structure, the overall periphery of the surface of the second soft ferrite core arranged on the side of the second convex portions of the spacer is enclosed with the second convex portions, whereby the periphery of the surface of the soft ferrite core can be inhibited from outward exposure. Thus, the second soft ferrite core can be inhibited from damage.

In this case, the first surface of the spacer is preferably fixed to a first surface of the first soft ferrite core constituting the magnetic gap through the sheet-shaped adhesive layers so that the first convex portions enclose at least four corners of the periphery of the first surface, while the second surface of the spacer is preferably in contact with a second surface of the second soft ferrite core constituting the magnetic gap so that the second convex portions enclose the overall periphery of the second surface. According to this structure, the spacer can be more reliably inhibited from dropping in the state where the spacer is mounted on the first and second soft ferrite cores.

In the aforementioned transformer core according to the first aspect, the sheet-shaped adhesive layers are preferably bonded substantially over the full length of the spacer. According to this structure, the bonding areas of the spacer with respect to the first surfaces of the soft ferrite cores constituting the magnetic gap can be increased, whereby the spacer can be more inhibited from dropping even when the pair of core cases are brought into the open state with the clamp mechanism.

In the aforementioned transformer core according to the first aspect, the sheet-shaped adhesive layers preferably include double-faced adhesive tapes, and the double-faced adhesive tapes are preferably bonded to the first surface of the spacer to connect the regions of the pair of opposing sides not provided with the first convex portions with each other. According to this structure, the thickness of the adhesive layers formed by the double-faced adhesive tapes can be rendered constant dissimilarly to a case of employing a pasty adhesive, whereby the magnetic gap can be rendered constant. Thus, the inductance of the transformer core can be rendered more constant. Further, the adhesive layers formed by the double-faced adhesive tapes are so bonded to the surface of the spacer that no adhesive may be dried (solidified) dissimilarly to a case of employing a pasty adhesive, whereby the operation of bonding the spacer to the transformer core can be easily performed.

A transformer core according to a second aspect of the present invention is a method of manufacturing a transformer core comprising a pair of soft ferrite cores having semicircular inner peripheral surfaces, a pair of core cases storing the pair of soft ferrite cores therein respectively so that the pair of ferrite cores are opposed to each other to constitute a magnetic gap, a clamp mechanism coupling first ends of the pair of core cases with each other in an openable/closable manner, a rectangular spacer arranged in the magnetic gap and integrally provided with first convex portions on four sides of a first surface while having regions not provided with the first convex portions on at least parts of a pair of opposing sides and sheet-shaped adhesive layers bonded to at least the regions of the first surface of the spacer not provided with the first convex portions for bonding the soft ferrite cores and the spacer to each other, comprising steps of arranging a plurality of spacers so that the regions not provided with the first convex portions are continuous with each other, bonding the sheet-shaped adhesive layers to the first surfaces of the spacers to extend over the regions of the plurality of spacers not provided with the first convex portions and cutting the sheet-shaped adhesive layers along the boundary region between the respective spacers.

In this method of manufacturing a transformer core according to the second aspect, as hereinabove described, the plurality of spacers are so arranged that the regions not provided with the first convex portions are continuous with each other while the sheet-shaped adhesive layers are bonded to the first surfaces of the spacers to extend over the regions of the plurality of spacers not provided with the first convex portions and the adhesive layers are thereafter cut along the boundary region between the respective spacers so that the sheet-shaped adhesive layers can be simultaneously arranged on the plurality of spacers, whereby the step of providing the adhesive layers on the spacers can be more simplified. Further, the sheet-shaped adhesive layers are cut along the boundary region between the respective spacers so that the sheet-shaped adhesive layers can be arranged over the full length of the spacers, whereby bonding areas of the spacers with respect to the surfaces of the soft ferrite cores constituting the magnetic gap can be increased. Consequently, the spacer can be more inhibited from dropping even when the pair of core cases are brought into an open state with the clamp mechanism.

In the aforementioned method of manufacturing a transformer core according to the second aspect, the sheet-shaped adhesive layers preferably have a width not more than the width of the regions not provided with the first convex portions. According to this structure, a sheet-shaped adhesive can be easily bonded to the regions not provided with the first convex portions, whereby the step of providing the adhesive layers can be easily simplified.

In the aforementioned method of manufacturing a transformer core according to the second aspect, the sheet-shaped adhesive layers preferably have a substantially unchanging thickness. According to this structure, the surfaces of the soft ferrite cores constituting the magnetic gap and the spacer can be parallelly bonded to each other dissimilarly to a case where the thickness of the sheet-shaped adhesive layers changes, whereby the magnetic gap of the pair of opposite soft ferrite cores can be kept constant.

The aforementioned method of manufacturing a transformer core according to the second aspect preferably further comprises a step of mounting the spacer on the first surfaces of the soft ferrite cores constituting the magnetic gap from the vertical direction through the sheet-shaped adhesive layers after cutting the sheet-shaped adhesive layers. When the transformer core is so formed as to mount the spacer from the vertical direction in this manner, the spacer can be easily mounted on the first surfaces of the soft ferrite cores even when the first convex portions are provided on the four sides of the spacer.

In the aforementioned method of manufacturing a transformer core according to the second aspect, the spacer is preferably provided with the regions not provided with the first convex portions on parts of the pair of opposing sides out of the four sides of the first surface in order to bond the sheet-shaped adhesive layers, while the first convex portions are preferably provided substantially on all regions of the remaining pair of opposing sides. According to this structure, contact areas between the peripheral portions of the surfaces of the soft ferrite cores constituting the magnetic gap and the first convex portions of the spacer can be increased when the spacer is bonded to the surfaces of the soft ferrite cores constituting the magnetic gap, whereby the spacer can be more effectively inhibited from slipping off the magnetic gap of the soft ferrite cores.

In the aforementioned method of manufacturing a transformer core according to the second aspect, the spacer is preferably provided with the regions not provided with the first convex portions on the pair of opposing sides and the remaining pair of opposing sides out of the four sides of the first surface respectively for bonding the sheet-shaped adhesive layers. According to this structure, the adhesive layers can be arranged on both of the vertical and horizontal directions of the first surface of the spacer, whereby workability at the time of bonding the adhesive layers to the spacer can be improved.

In the aforementioned method of manufacturing a transformer core according to the second aspect, the spacer is preferably integrally provided with second convex portions on substantially all regions of the four sides of a second surface. According to this structure, the overall periphery of the surface of the second soft ferrite core arranged on the side of the second convex portions of the spacer is enclosed with the second convex portions, whereby the periphery of the surface of the soft ferrite core can be inhibited from outward exposure. Thus, the second soft ferrite core can be inhibited from damage.

In this case, the method preferably further comprises steps of fixing the first surface of the spacer to the first surface of the first soft ferrite core constituting the magnetic gap through the sheet-shaped adhesive layers so that the first convex portions enclose at least four corners of the periphery of the first surface after cutting the sheet-shaped adhesive layers and bringing a second surface of the spacer into contact with the second surface of the second soft ferrite core constituting the magnetic cap so that the second convex portions enclose the overall periphery of the second surface. According to this structure, the spacer can be more reliably inhibited from dropping in the state where the spacer is mounted on the first and second soft ferrite cores.

In the aforementioned method of manufacturing a transformer core according to the second aspect, the step of bonding the sheet-shaped adhesive layers to the first surface of the spacer preferably includes a step of bonding the sheet-shaped adhesive layers substantially over the full length of the spacer. According to this structure, the bonding areas of the spacer with respect to the first surfaces of the soft ferrite cores constituting the magnetic gap can be increased, whereby the spacer can be more inhibited from dropping even when the pair of core cases are brought into the open state with the clamp mechanism.

In the aforementioned method of manufacturing a transformer core according to the second aspect, the sheet-shaped adhesive layers preferably include double-faced adhesive tapes, and the step of bonding the sheet-shaped adhesive layers to the first surface of the spacer preferably includes a step of bonding the double-faced adhesive tapes to the first surface of the spacer to connect the regions of the pair of opposing sides not provided with the first convex portions with each other. According to this structure, the thickness of the adhesive layers formed by the double-faced adhesive tapes can be rendered constant dissimilarly to a case of employing a pasty adhesive, whereby the magnetic gap can be rendered constant. Thus, the inductance of the transformer core can be rendered more constant. Further, the adhesive layers formed by the double-faced adhesive tapes are so bonded to the surface of the spacer that no adhesive may be dried (solidified) dissimilarly to a case of employing a pasty adhesive, whereby the operation of bonding the spacer to the transformer core can be easily performed.

BEST MODES FOR CARRYING OUT THE INVENTION

Embodiments of the present invention are now described with reference to the drawings.

First Embodiment

First, the structure of a transformer core 1 according to a first embodiment is described with reference to FIGS. 1 to 6.

Figure 1:
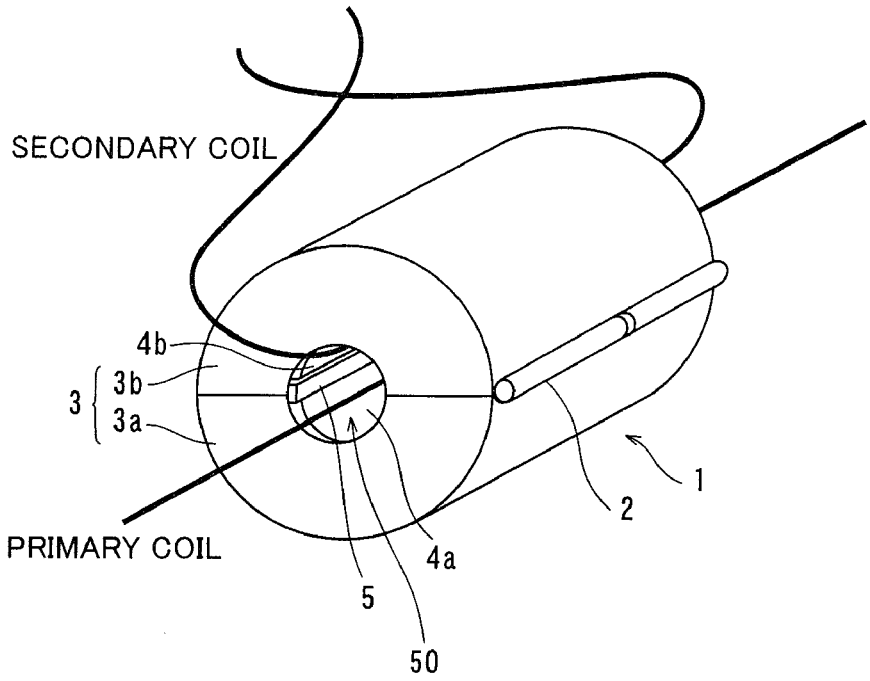
[FIG. 1] A schematic diagram showing a state of mounting a transformer core according to a first embodiment of the present invention on a primary coil and a secondary coil.
Figure 2:
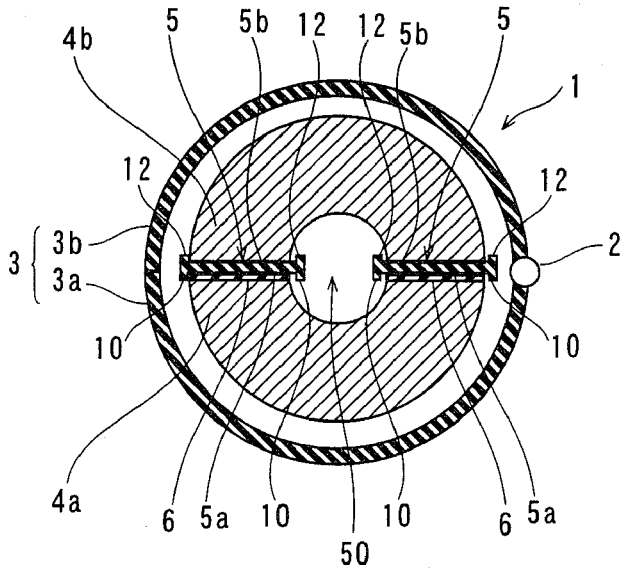
[FIG. 2] A sectional view showing a state where core cases of the transformer core according to the first embodiment shown in FIG. 1 are closed.
Figure 3:
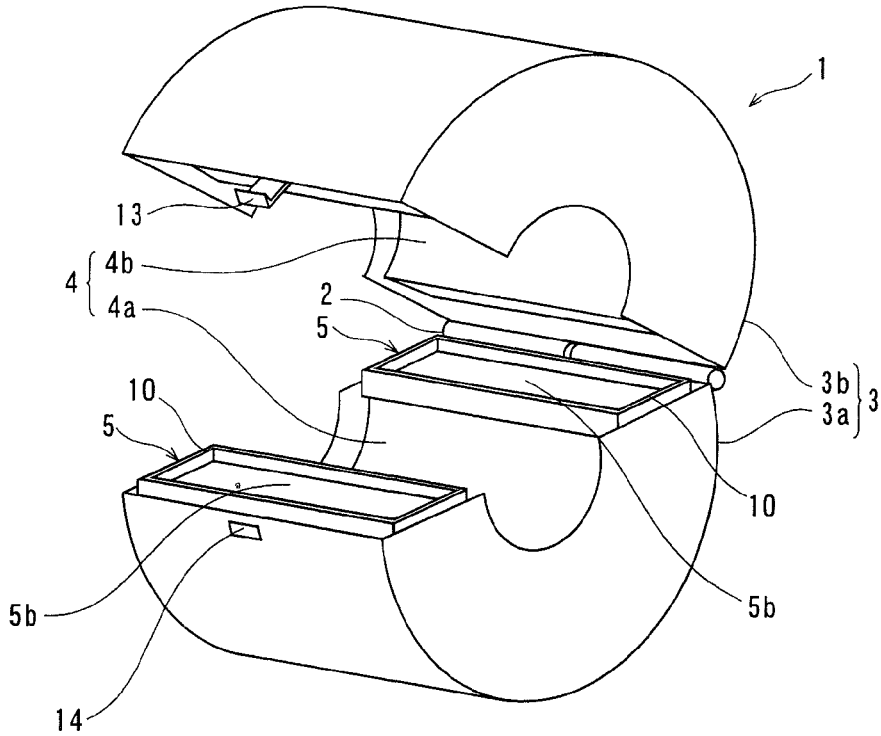
[FIG. 3] A schematic diagram showing a state where the core cases of the transformer core according to the first embodiment shown in FIG. 1 are open.

According to the first embodiment, the transformer core 1 is constituted of a clamp mechanism 2, a core case 3, a soft ferrite core 4, spacers 5 and sheet-shaped adhesive layers 6 formed by double-faced adhesive tapes substantially unchanging in thickness, as shown in FIGS. 1 to 3.

More specifically, the core case 3 is formed by a pair of a first core case 3*a* and a second core case 3*b* having semicircular outer peripheral surfaces, and the first core case 3*a* and the second core case 3*b* are coupled with each other through the clamp mechanism 2. As shown in FIG. 3, the first core case 3*a* has a pawl 13, while the second core case 3*b* has an engaging hole 14 engageable with the pawl 13 of the first core case 3*a*. With this pawl 13 and the engaging hole 14, the first core case 3*a* and the second core case 3*b* are so formed as to keep a closed state in a state where no force is applied. The pair of the first core case 3*a* and the second core case 3*b* have hollow portions, and are so formed as to store a first soft ferrite core 4*a* and a second soft ferrite core 4*b* respectively. The first core case 3*a* and the second core case 3*b* are made of heat-resistant resin such as polycarbonate resin.

The first soft ferrite core 4*a* and the second soft ferrite core 4*b* are so formed as to have semicircular inner peripheral surfaces and outer peripheral surfaces respectively, as shown in FIG. 2. Further, the first soft ferrite core 4*a* and the second soft ferrite core 4*b* are opposed to each other in the closed state of the core case 3. The opposite surfaces of the first soft ferrite core 4*a* and the second soft ferrite core 4*b* serve as surfaces constituting a magnetic gap. According to this embodiment, the thickness of the magnetic gap corresponds to the sum of the thicknesses of the spacers 5 and the adhesive layers 6. The first soft ferrite core 4*a* and the second soft ferrite core 4*b* opposed to each other are constituted substantially in the form a cylinder having a receiving hole 50 in the state holding the magnetic gap therebetween. According to this embodiment, a primary coil and a secondary coil whose both ends are connected to a substrate respectively are arranged in the receiving hole 50 of the first soft ferrite core 4*a* and the second soft ferrite core 4*b* to pass through the same. The first soft ferrite core 4*a* and the second soft ferrite core 4*b* are fixed into the first core case 3*a* and the second core case 3*b* by core holding members (not shown) respectively.

According to this embodiment, first surfaces 5*a* of the spacers 5 are bonded to oblong surfaces of the first soft ferrite core 4*a* constituting the magnetic gap, as shown in FIGS. 2 and 3. These spacers 5 have the oblong first surfaces 5*a* corresponding to the oblong surfaces of the first soft ferrite core 4*a*. The spacers 5 are mounted on the surfaces of the first soft ferrite core 4*a* constituting the magnetic gap from a vertical direction through the adhesive layers 6 formed by the double-faced adhesive tapes having heat resistance. The spacers 5 are made of heat-resistant resin such as polycarbonate resin.

Figure 4:
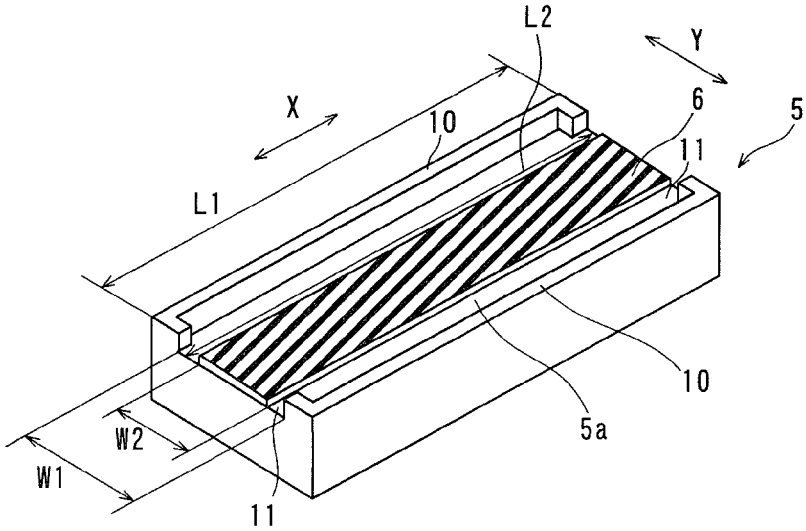
[FIG. 4] A perspective view of a spacer according to the first embodiment shown in FIG. 1 as viewed from the side of a first surface.

Convex portions 10 are integrally provided on four sides of the first surface 5*a* of each spacer 5, as shown in FIG. 4. Regions 11 not provided with parts of the convex portions 10 are formed on parts of a pair of opposing sides of the first surface 5*a* of this spacer 5, while the convex portions 10 are provided on all regions of the remaining pair of opposing sides. These convex portions 10 are examples of the "first convex portions" in the present invention.

The sheet-shaped adhesive layers 6 formed by the double-faced adhesive tapes have a length L2 substantially identical to the full length L1 of the spacers 5 in a direction X, and has a width W2 not more than the width W1 of the regions 11 not provided with the convex portions 10 in a direction Y. Further, the adhesive layers 6 are so arranged that the center of the width of the regions 11 not provided with the convex portions in the direction Y and the center of the width of the adhesive layers 6 in the direction Y coincide with each other.

Figure 5:
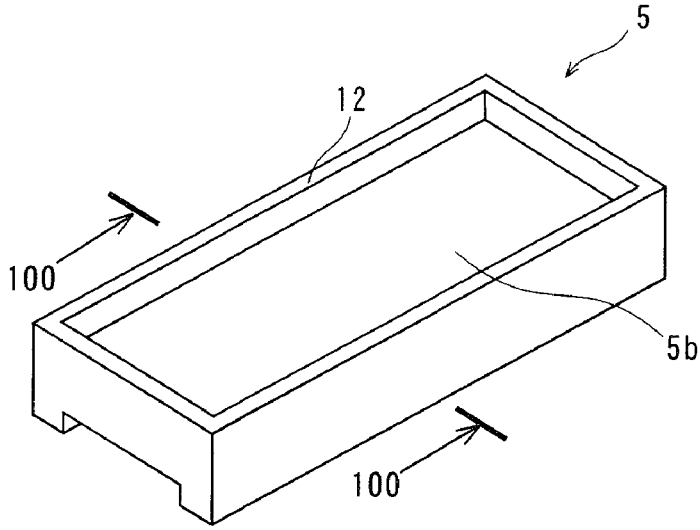
[FIG. 5] A perspective view of the spacer according to the first embodiment shown in FIG. 1 as viewed from the side of a second side.
Figure 6:
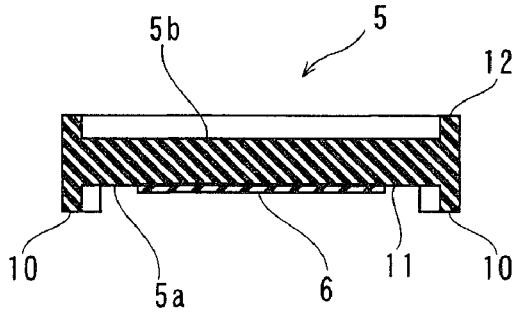
[FIG. 6] A sectional view taken along the line 100-100 in FIG. 5.

On four sides of a second surface 5*b* of each spacer 5, convex portions 12 are integrally provided on all regions, as shown in FIG. 5. The convex portions 12 are examples of the "second convex portions" in the present invention. A corresponding surface of the second soft ferrite core 4*b* constituting the magnetic gap is in contact with the second surface 5*b* of each spacer 5 in the closed state of the core case 3.

A method of bonding the adhesive layers 6 to the first surfaces 5*a* of the spacers 5 according to the first embodiment is now described with reference to FIGS. 7 and 8.

Figure 7:
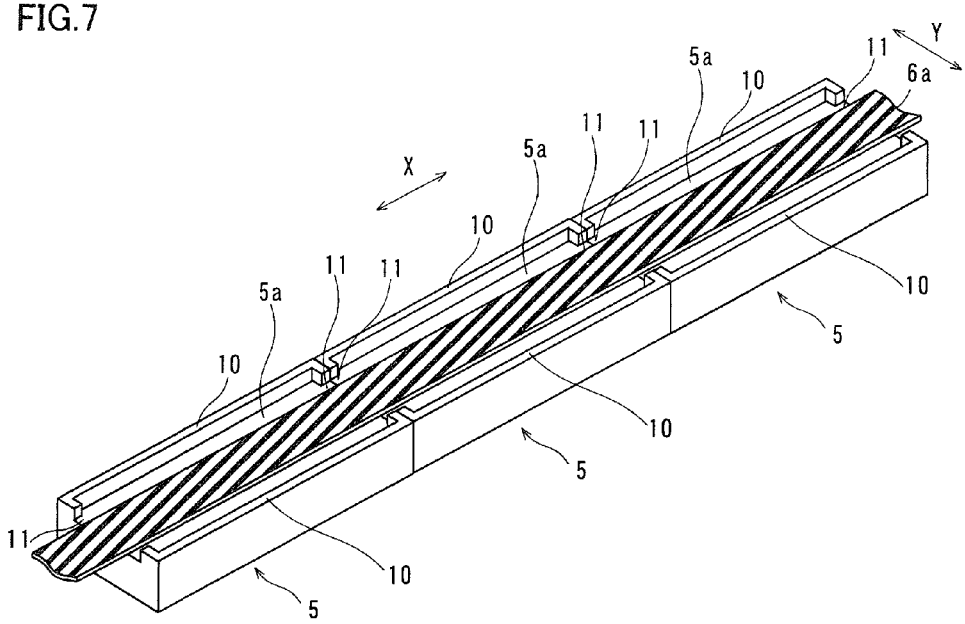
[FIG. 7] A perspective view for illustrating a method of bonding an adhesive layer to the spacer according to the first embodiment shown in FIG. 1.

First, a plurality of spacers 5 are so aligned with each other that the regions 11 of the surfaces not provided with the convex portions 10 are continuous with each other, as shown in FIG. 7. At this time, the spacers 5 are so arranged that the regions 11 of the respective spacers 5 not provided with the convex portions 10 coincide with each other. Then, a double-faced adhesive tape 6*a* is bonded to the plurality of aligned spacers 5, to extend over the regions 11 of the spacers 5 not provided with the convex portions 10. At this time, the double-faced adhesive tape 6*a* is so arranged that the central portion of the double-faced adhesive tape 6*a* in the direction Y and the central portions of the regions 11 not provided with the convex portions 10 in the direction Y coincide with each other.

Figure 8:
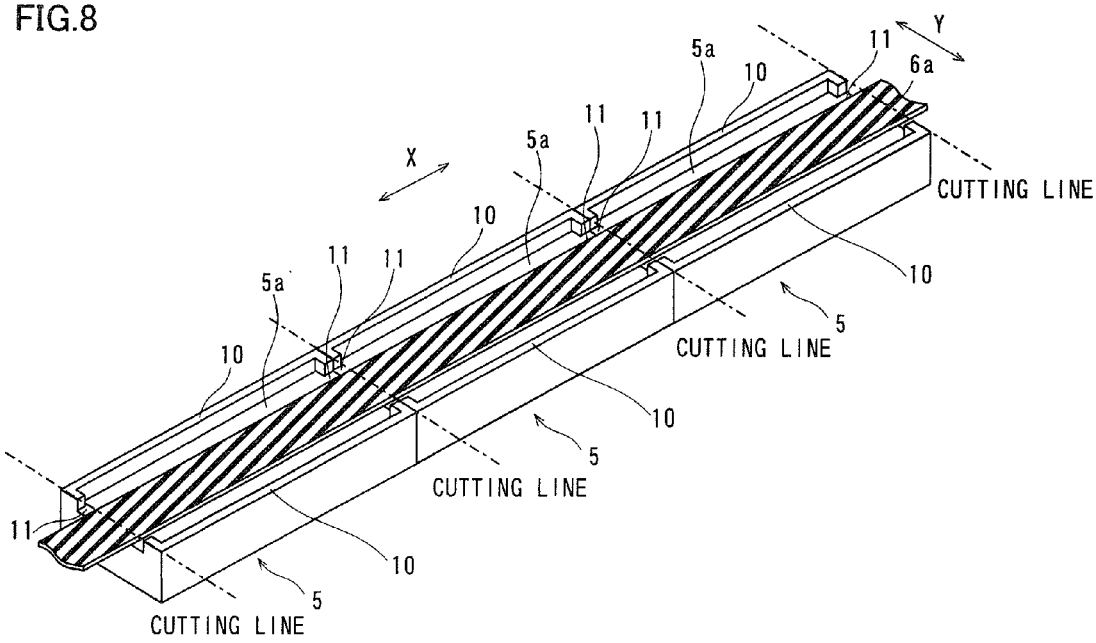
[FIG. 8] A perspective view for illustrating the method of bonding the adhesive layer to the spacer according to the first embodiment shown in FIG. 1.

Then, the double-faced adhesive tape 6*a* is cut along cutting lines with a cutting machine (not shown) such as a cutter, as shown in FIG. 8. At this time, the cutting lines are so arranged as to perpendicularly intersect with the X direction of the plurality of aligned spacers 5. Further, the cutting lines are conformed to the boundary region between and both ends of the plurality of spacers 5 in the direction X. Thus, the sheet-shaped adhesive layers 6 formed by the double-faced adhesive tapes are simultaneously bonded to the plurality of spacers 5.

A method of mounting the spacers 5 to which the adhesive layers 6 formed by the double-faced adhesive tapes are bonded in the aforementioned manner on the soft ferrite core 4 is now described with reference to FIGS. 3 and 4.

First, the first core case 3*a* and the second core case 3*b* coupled with each other by the clamp mechanism 2 are brought into the open state, and the first surfaces 5*a* of the spacers 5 on which the convex portions 10 (see FIG. 4) are formed and to which the adhesive layers 6 formed by the double-faced adhesive tapes are bonded and the surfaces of the first soft ferrite core 4*a* (see FIG. 3) forming the magnetic gap are opposed to each other, as shown in FIG. 3. Then, the spacers 5 are moved toward the surfaces of the first ferrite core 4*a* from the direction perpendicular to the surfaces of the first soft ferrite core 4*a* forming the magnetic gap. At this time, the spacers 5 are so brought into contact with the surfaces of the first soft ferrite core 4*a* from the vertical direction that the convex portions 10 of the spacers 5 enclose the peripheral portions of the surfaces of the first soft ferrite core 4*a* forming the magnetic gap. Thus, the first surfaces 5*a* of the spacers 5 are fixed to the first soft ferrite core 4*a* through the adhesive layers 6.

A method of mounting the transformer core 1 on the primary coil and the secondary coil is now described with reference to FIGS. 1 to 6.

First, the first core case 3*a* and the second core case 3*b* of the transformer core 1 are brought into the open state by disengaging the pawl 13 of the first core case 3*a* from the engaging hole 14, as shown in FIG. 3. Thus, the first soft ferrite core 4*a* and the second soft ferrite core 4*b* are also kept in the open state. In the state where the first core case 3*a* and the second core case 3*b* are open, the primary coil and the secondary coil are arranged on the inner peripheral surfaces of the first soft ferrite core 4*a* and the second soft ferrite core 4*b*. Thereafter the first soft ferrite core 4*a* and the second soft ferrite core 4*b* are so closed that the primary coil and the secondary coil are arranged in the receiving hole 50 formed by the inner peripheral surfaces of the first soft ferrite core 4*a* and the second soft ferrite core 4*b*, as shown in FIG. 1. At this time, all regions of the peripheral portions of the surfaces of the second soft ferrite core 4*b* constituting the magnetic gap are arranged to be enclosed with the convex portions 12 of the second surfaces 5*b* of the spacers 5. Consequently, the first soft ferrite core 4*a* and the second soft ferrite core 4*b* are opposed to each other for forming the magnetic gap. Thus, the transformer core 1 is mounted on the primary coil and the secondary coil.

According to the first embodiment, as hereinabove described, the pair of the first soft ferrite core 4*a* and the second soft ferrite core 4*b* having the semicircular shapes are stored in the pair of the first core case 3*a* and the second core case 3*b* so that the pair of the first soft ferrite core 4*a* and the second soft ferrite core 4*b* are opposed to each other to form the magnetic gap while first ends of the pair of the first core case 3*a* and the second core case 3*b* are coupled with each other with the openable/closable clamp mechanism 2 so that the pair of core cases 3 can be mounted on the primary coil and the secondary coil in the open state, whereby the semicircular pair of soft ferrite cores 4 can be easily mounted also on coils whose both ends are connected to a substrate or the like. Further, the rectangular spacers 5 are arranged in the magnetic gap of the first soft ferrite core 4*a* while the convex portions 10 are integrally provided on the four sides of the first surface 5*a* of each spacer 5 so that the spacer 5 can be inhibited from slipping off the magnetic gap of the first soft ferrite core 4*a*, whereby the magnetic gap can be inhibited from fluctuation.

According to the first embodiment, the regions 11 not provided with the convex portions 10 are formed on at least the pair of opposing sides of each spacer 5 while the sheet-shaped adhesive layers 6 formed by the double-faced adhesive tapes for bonding the first soft ferrite core 4*a* and the spacer 5 to each other are bonded to at least the regions 11 not provided with the convex portions 10, whereby the step of providing the adhesive layers can be simplified as compared with a case of applying or injecting a pasty adhesive and solidifying (curing) the same. Further, the sheet-shaped adhesive layers 6 formed by the double-faced adhesive tapes are bonded to the regions 11 of at least the pair of opposing sides of each spacer 5 not provided with the convex portions 10 so that the step of bonding the adhesive layers 6 by so arranging the plurality of spacers 5 as to couple the regions 11 not provided with the convex portions 10 with each other while bonding the sheet-shaped adhesive layers 6 formed by the double-faced adhesive tapes to extend over the regions 11 of the plurality of spacers 5 not provided with the convex portions 10 can be carried out, whereby the sheet-shaped adhesive layers 6 formed by the double-faced adhesive tapes can be simultaneously provided with respect to the plurality of spacers 5. Thus, the step of providing the adhesive layers 6 can be further simplified. In addition, the first soft ferrite core 4*a* and the spacers 5 can be easily bonded to each other with the sheet-shaped adhesive layers 6 formed by the double-faced adhesive tapes, whereby the spacers 5 can be inhibited from slipping off the magnetic gap of the first ferrite core 4*a* and the second ferrite core 4*b* even when the pair of core cases 3 are rendered openable/closable with the clamp mechanism 2.

According to the first embodiment, the sheet-shaped adhesive layers 6 formed by the double-faced adhesive tapes are so formed as to have the width W2 not more than the width W1 of the regions 11 not provided with the convex portions 10 so that the sheet-shaped adhesive layers 6 formed by the double-faced adhesive tapes can be easily bonded to the regions 11 not provided with the convex portions 10, whereby the step of providing the adhesive layers 6 can be easily simplified.

According to the first embodiment, each spacer 5 is so formed as to be mounted on the corresponding surface of the first soft ferrite core 4*a* constituting the magnetic gap from the vertical direction through the sheet-shaped adhesive layers 6, whereby the spacer 5 can be easily mounted on the corresponding surface of the soft ferrite core 4*a* even when the convex portions 10 are provided on the four sides of the spacer 5.

According to the first embodiment, each spacer 5 is provided with the regions 11 not provided with the convex portions 10 for bonding the sheet-shaped adhesive layers 6 on parts of the pair of opposing sides out of the four sides of the first surface 5*a* while the convex portions 10 are provided substantially on all regions of the remaining pair of opposing sides so that the contact areas between the peripheral portion of the corresponding surface of the first soft ferrite core 4*a* constituting the magnetic gap and the convex portions 10 of the spacer 5 can be increased when the spacer 5 is bonded to the corresponding surface of the first soft ferrite core 4*a* constituting the magnetic gap, whereby the spacer 5 can be more effectively inhibited from slipping off the magnetic gap of the first soft ferrite core 4*a*.

According to the first embodiment, each spacer 5 is so formed that the convex portions 12 are integrally provided on substantially all regions of the four sides of the second surface 5*b* so that the overall peripheral portion of the corresponding surface of the second soft ferrite core 4*b* arranged on the side of the convex portions 12 of the spacer 5 is enclosed with the convex portions 12, whereby the periphery of the surface of the second soft ferrite core 4*b* can be inhibited from outward exposure. Thus, the second soft ferrite core 4*b* can be inhibited from damage.

According to the first embodiment, the first surface 5*a* of each spacer 5 is fixed to the corresponding surface of the first soft ferrite core 4*a* constituting the magnetic gap through the sheet-shaped adhesive layers 6 formed by the double-faced adhesive tapes so that the convex portions 10 enclose at least four corners of the periphery of the surface while the second surface 5*b* of the spacer 5 is brought into contact with the corresponding surface of the second soft ferrite core 4*b* constituting the magnetic gap so that the convex portions 12 enclose the overall periphery of the surface, whereby the spacer 5 can be more reliably inhibited from dropping in the state where the spacers 5 are mounted on the first soft ferrite core 4*a* and the second soft ferrite core 4*b*.

According to the first embodiment, the sheet-shaped adhesive layers 6 formed by the double-faced adhesive tapes are so formed that the same are bonded substantially over the full length of the spacers 5 so that the bonding areas of the spacers 5 with respect to the surfaces of the first soft ferrite core 4*a* constituting the magnetic gap can be increased, whereby the spacers 5 can be further inhibited from dropping even when the pair of core cases 3 are brought into the open state with the clamp mechanism 2.

In the method of bonding the adhesive layers 6 to the spacers 5 according to the first embodiment, the sheet-shaped adhesive layers 6 formed by the double-faced adhesive tapes can be simultaneously arranged on the plurality of spacers 5 by arranging the plurality of spacers 5 so that the regions 11 not provided with the convex portions 10 are continuous with each other while bonding the sheet-shaped adhesive layers 6 formed by the double-faced adhesive tapes to the first surfaces 5*a* of the spacers 5 and thereafter cutting the sheet-shaped adhesive layers 6 formed by the double-faced adhesive tapes along the boundary region between the respective spacers, whereby the step of providing the sheet-shaped adhesive layers 6 formed by the double-faced adhesive tapes on the spacers 5 can be more simplified. Further, the sheet-shaped adhesive layers 6 formed by the double-faced adhesive tapes can be arranged over the full lengths of the spacers 5 by cutting the sheet-shaped adhesive layers 6 formed by the double-faced adhesive tapes along the boundary region between the respective spacers 5, whereby the bonding areas of the spacers 5 with respect to the surfaces of the first soft ferrite core 4*a* constituting the magnetic gap can be increased. Consequently, the spacers 5 can be more inhibited from dropping even when the pair of core cases 3 are brought into the open state with the clamp mechanism 2.

Second Embodiment

Figure 9:
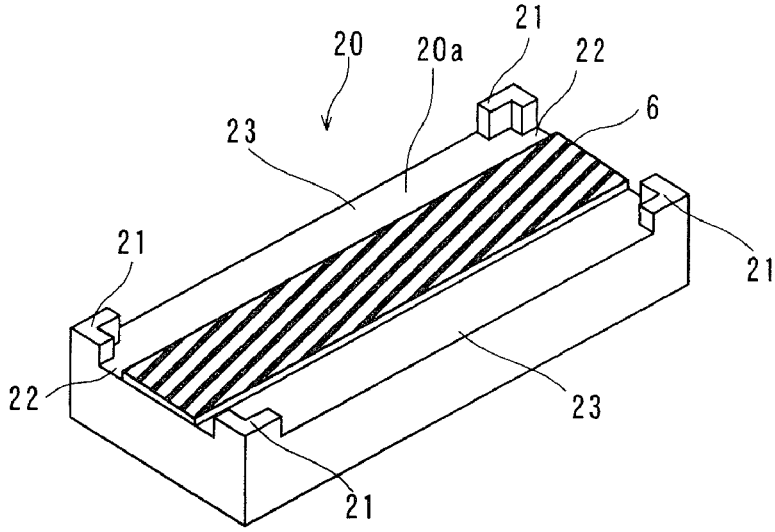
[FIG. 9] A perspective view of a spacer according to a second embodiment of the present invention as viewed from the side of a first surface.
Figure 10:
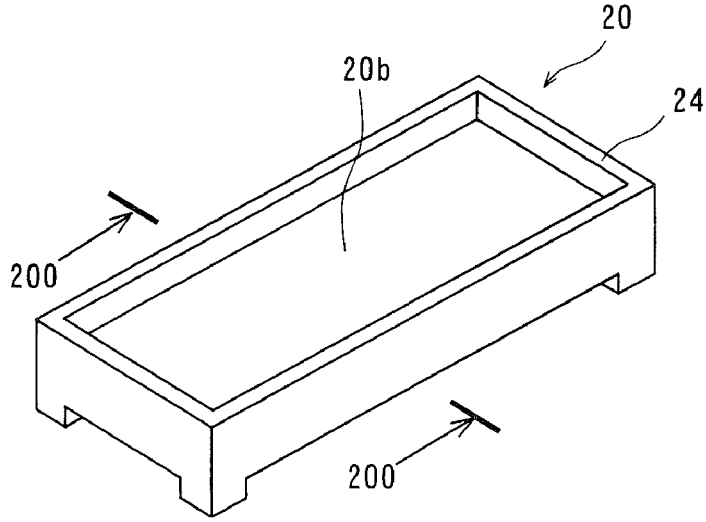
[FIG. 10] A perspective view of the spacer according to the second embodiment shown in FIG. 9 as viewed from the side of a second surface.
Figure 11:
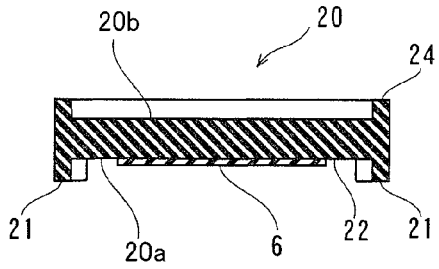
[FIG. 11] A sectional view taken along the line 200-200 in FIG. 10.

Referring to FIGS. 9 to 11, this second embodiment is described with reference to a case of employing a spacer provided with regions not provided with convex portions on parts of the respective ones of a pair of opposing sides of convex portions of a first surface and the remaining pair of opposing sides, dissimilarly to the aforementioned first embodiment.

According to this embodiment, convex portions 21 are integrally provided on four sides of a first surface 20*a* of a spacer 20, as shown in FIGS. 9 and 11. Further, regions 22 and 23 not provided with the convex portions 21 are provided on a pair of opposing sides and the remaining pair of opposing sides respectively, and the convex portions 21 are formed on the four corners of the first surface 20*a* of the spacer 20. The convex portions 21 are examples of the "first convex portions" in the present invention.

On four sides of a second surface 20*b* of the spacer 20, convex portions 24 are integrally provided on all regions, as shown in FIG. 10. The convex portions 24 are examples of the "second convex portions" in the present invention. The remaining structure of a transformer core according to the second embodiment is similar to that of the aforementioned first embodiment, and hence redundant description is omitted.

A method of mounting the spacer 20 according to the second embodiment on a soft ferrite core 4 and a method of mounting the transformer core on a primary coil and a secondary coil are similar to the methods in the aforementioned first embodiment, and hence redundant description is omitted.

A method of bonding an adhesive layer 6 to the first surface 20*a* of the spacer 20 according to the second embodiment is now described with reference to FIGS. 12 and 13.

Figure 12:
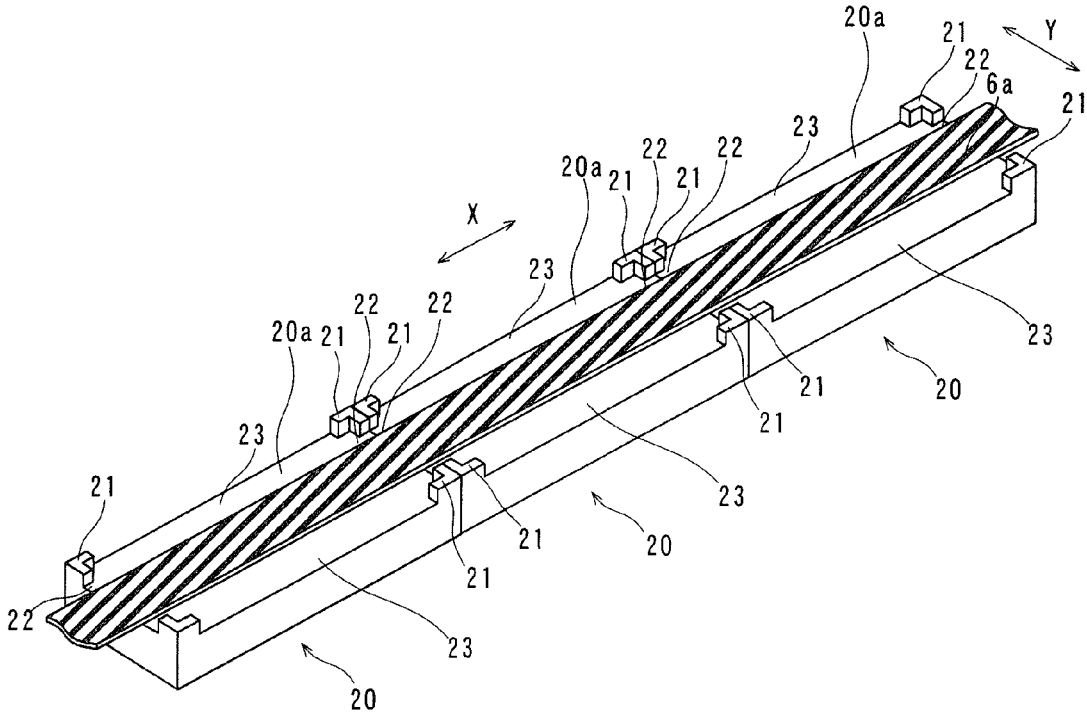
[FIG. 12] A perspective view for illustrating a method of bonding an adhesive layer to the spacer according to the second embodiment shown in FIG. 9.

First, a plurality of spacers 20 are aligned with each other so that the regions 22 of the surfaces not provided with the convex portions 21 are continuous with each other, as shown in FIG. 12. At this time, the spacers 20 are so arranged that the regions 22 of the respective spacers 20 not provided with the convex portions coincide with each other. Then, a double-faced adhesive tape 6*a* is bonded to the plurality of aligned spacers 20, to extend over the regions 22 of the spacers 20 not provided with the convex portions 21. At this time, the double-faced adhesive tape 6*a* is so arranged that a central portion of the double-faced adhesive tape 6*a* in a direction Y and central portions of the regions 22 not provided with the convex portions 21 in the direction Y coincide with each other.

Figure 13:
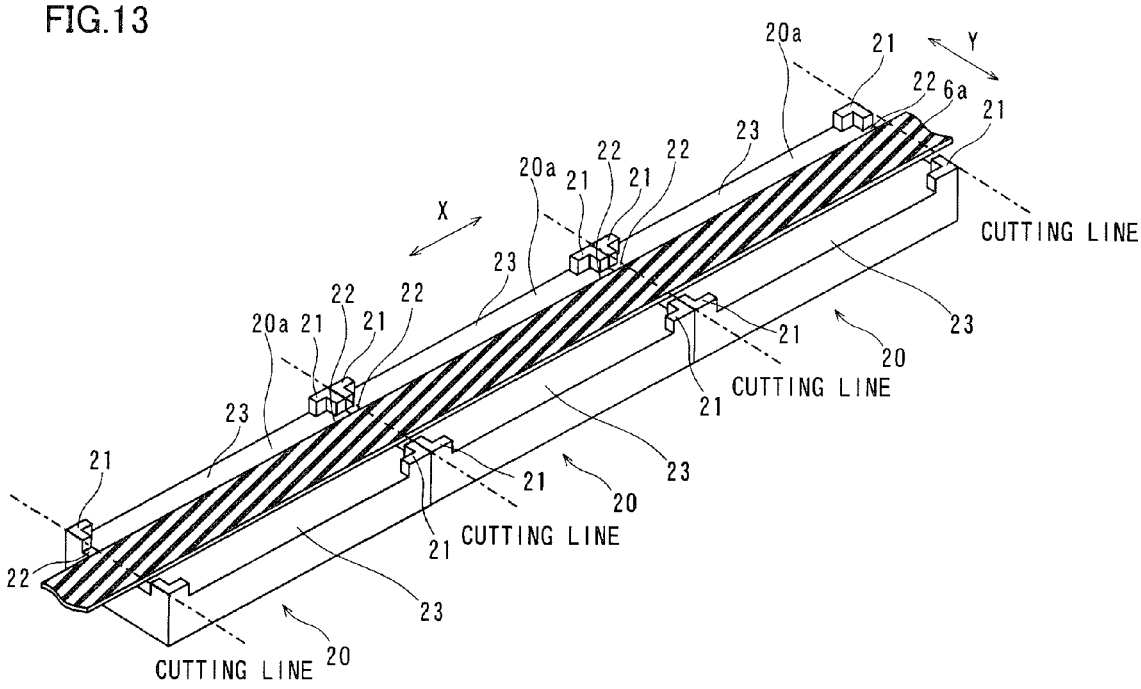
[FIG. 13] A perspective view for illustrating the method of bonding the adhesive layer to the spacer according to the second embodiment shown in FIG. 9.

Then, the double-faced adhesive tape 6*a* is cut along cutting lines with a cutting machine (not shown) such as a cutter, as shown in FIG. 13. At this time, the cutting lines are so arranged as to perpendicularly intersect with an X direction of the aligned spacers 20. Further, the cutting lines are conformed to the boundary region between and both ends of the plurality of spacers 20 in the direction X. Thus, the adhesive layer 6 formed by the double-faced adhesive tape 6*a* is simultaneously bonded to the plurality of spacers 20.

The effects of the second embodiment are similar to those of the aforementioned first embodiment.

The embodiments disclosed this time must be considered as illustrative and not restrictive in all points. The range of the present invention is shown not by the above description of the embodiments but by the scope of claims for patent, and all modifications within the meaning and the range equivalent to the scope of claims for patent are included.

For example, while the transformer core is constituted of the core cases having the semicircular outer peripheral surfaces and the soft ferrite cores having the semicircular inner and outer peripheral surfaces in each of the aforementioned embodiments, the present invention is not restricted to this but the transformer core may be constituted of core cases and soft ferrite cores having other shapes, so far as the same are shapes substantially annularly formed by being opposed to each other. For example, an annular transformer core may be constituted of soft ferrite cores provided with at least either inner peripheral surfaces or outer peripheral surfaces having U shapes.

While the transformer core is constituted of the spacers having the oblong surfaces in each of the aforementioned embodiments, the present invention is not restricted to this but the transformer core may be constituted of spacers having rectangular surfaces other than oblong surfaces.

While the convex portions are integrally provided on substantially all regions of the four sides of the second surface of each spacer in each of the aforementioned embodiments, the present invention is not restricted to this but the convex portions may be provided on parts of the four sides of the second surface of the spacer, or no convex portions may be provided on the second surface of the spacer.

While the adhesive layers are arranged on only one of the surfaces of each spacer in each of the aforementioned embodiments, the present invention is not restricted to this but the adhesive layers may be arranged on both surfaces of the spacer.

Figure 14:
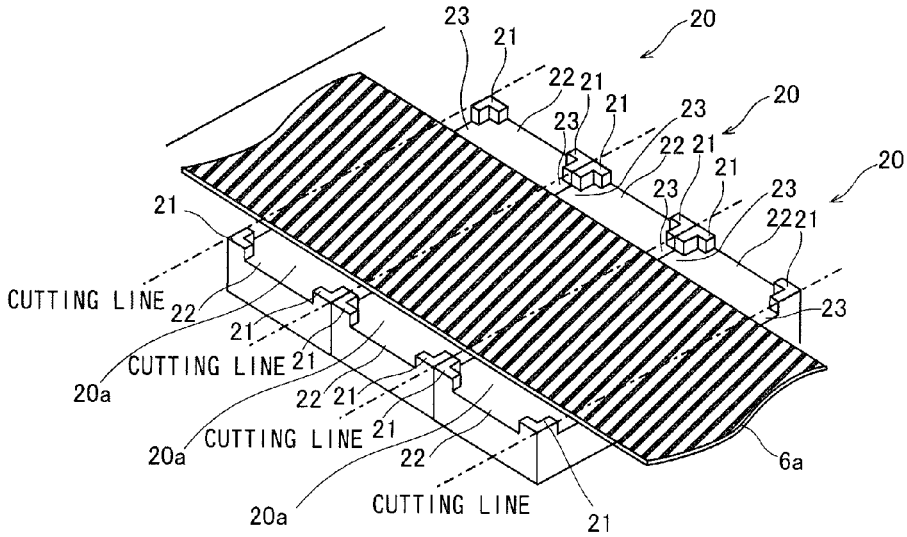
[FIG. 14] A perspective view for illustrating a method of bonding an adhesive layer to spacers according to a modification of the second embodiment of the present invention.

While the adhesive layer 6 is bonded in the X direction of the spacer 20 in the aforementioned second embodiment, the present invention is not restricted to this but a bodying layer 6 may be bonded in a Y direction of a spacer 20, as shown in a modification of FIG. 14. In this case, regions 23 of spacers 20 not provided with convex portions 21 may be so arranged as to coincide with each other and a double-faced adhesive tape 6*a* may be so arranged on a plurality of aligned spacers 20 as to extend over the regions 23 of the spacers 20 not provided with the convex portions 21 in a step of bonding the adhesive layer 6 to the first surface 20*a* of the spacer 20.

While the double-faced adhesive tapes are employed as exemplary sheet-shaped adhesive layers in each of the aforementioned embodiments, the present invention is not restricted to this but sheet-shaped adhesive layers other than the double-faced adhesive tapes may be employed.

The invention claimed is:

1. A transformer core comprising:

a pair of soft ferrite cores (4) substantially annularly formed by being opposed to each other;

a pair of core cases (3) storing said pair of soft ferrite cores therein respectively so that said pair of ferrite cores are opposed to each other to constitute a magnetic gap;

a clamp mechanism (2) coupling first ends of said pair of core cases with each other in an openable/closable manner;

a rectangular spacer (5, 20) arranged in said magnetic gap and integrally provided with first convex portions (10, 21) on four sides of a first surface while having regions not provided with said first convex portions on at least parts of a pair of opposing sides; and sheet-shaped adhesive layers (6) bonded to at least the regions of the first surface of said spacer not provided with said first convex portions, for bonding said soft ferrite cores and said spacer to each other.

2. The transformer core according to claim 1, wherein said sheet-shaped adhesive layers have a width not more than the width of the regions not provided with said first convex portions.

3. The transformer core according to claim 1, wherein said sheet-shaped adhesive layers have a substantially unchanging thickness.

4. The transformer core according to claim 1, wherein said spacer is so formed as to be mounted on first surfaces of said soft ferrite cores constituting said magnetic gap from a vertical direction through said sheet-shaped adhesive layers.

5. The transformer core according to claim 1, wherein said spacer is provided with the regions not provided with said first convex portions on parts of said pair of opposing sides out of the four sides of said first surface in order to bond said sheet-shaped adhesive layers, while said first convex portions are provided substantially on all regions of the remaining pair of opposing sides.

6. The transformer core according to claim 1, wherein said spacer is provided with the regions not provided with said first convex portions on said pair of opposing sides and said remaining pair of opposing sides out of the four sides of said first surface respectively for bonding said sheet-shaped adhesive layers.

7. The transformer core according to claim 1, wherein said spacer is integrally provided with second convex portions (12, 24) on substantially all regions of the four sides of a second surface.

8. The transformer core according to claim 7, wherein the first surface of said spacer is fixed to a first surface of first said soft ferrite core constituting said magnetic gap through said sheet-shaped adhesive layers so that said first convex portions enclose at least four corners of the periphery of said first surface, while the second surface of said spacer is in contact with a second surface of second said soft ferrite core constituting said magnetic gap so that said second convex portions enclose the overall periphery of said second surface.

9. The transformer core according to claim 1, wherein said sheet-shaped adhesive layers are bonded substantially over the full length of said spacer.

10. The transformer core according to claim 1, wherein said sheet-shaped adhesive layers include double-faced adhesive tapes (6), and said double-faced adhesive tapes are bonded to the first surface of said spacer to connect the regions of said pair of opposing sides not provided with said first convex portions with each other.

* * * * *